US012180739B2

(12) United States Patent
Tarrant

(10) Patent No.: US 12,180,739 B2
(45) **Date of Patent: *Dec. 31, 2024**

(54) APPARATUS AND SYSTEM FOR MULTI-LEVEL PARKING

(71) Applicant: Broadway Patents LLC, New York, NY (US)

(72) Inventor: Padraig Tarrant, New York, NY (US)

(73) Assignee: Broadway Patents LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/482,532

(22) Filed: Oct. 6, 2023

(65) Prior Publication Data

US 2024/0110398 A1 Apr. 4, 2024

Related U.S. Application Data

(63) Continuation of application No. 17/702,428, filed on Mar. 23, 2022, now Pat. No. 11,781,335.

(51) Int. Cl.
*E04H 6/06* (2006.01)

(52) U.S. Cl.
CPC ..... *E04H 6/06* (2013.01)

(58) Field of Classification Search
CPC ..... E04H 6/06; E04H 6/012; E04H 7/0641; E04H 7/0633; E04H 7/06; B66F 7/0633
See application file for complete search history.

(56) References Cited

U.S. PATENT DOCUMENTS

| | | | | |
|---|---|---|---|---|
| 2,639,046 A | | 5/1953 | Magar | |
| 2,858,032 A | * | 10/1958 | Morley | B66F 7/08 414/241 |
| 4,772,172 A | | 9/1988 | Rosen | |
| 5,129,776 A | * | 7/1992 | Peng | B66F 7/0658 414/228 |
| 5,145,304 A | | 9/1992 | Rosen | |
| 5,330,310 A | | 7/1994 | Lin | |
| 5,743,696 A | | 4/1998 | Rossato | |
| 6,241,049 B1 | | 6/2001 | Gooch | |
| 6,607,343 B1 | | 8/2003 | Amgar | |
| 7,770,695 B2 | | 8/2010 | Myers | |

(Continued)

FOREIGN PATENT DOCUMENTS

| | | |
|---|---|---|
| CN | 201391101 | 1/2010 |
| CN | 202194412 U | 4/2012 |

(Continued)

*Primary Examiner* — Mark C Hageman
(74) *Attorney, Agent, or Firm* — NEO IP

(57) ABSTRACT

A device includes a plurality of support elements pivotably attached to a base. The support elements are pivotably attached to support arms. The support arms support a platform configured to hold a vehicle. The device is capable of moving between stacked and unstacked configurations, where the platform is elevated above a ground-level parking space when the device is in a stacked configuration and the platform is positioned behind or beside a ground-level parking space when the device is in an unstacked configuration. When changing between a stacked configuration and an unstacked configuration, the support elements and the support arms pivot such that the platform does not contact any vehicle parked underneath the platform.

18 Claims, 8 Drawing Sheets

(56) References Cited

U.S. PATENT DOCUMENTS

| | | | |
|---|---|---|---|
| 9,255,419 | B2 | 2/2016 | Van Stokes et al. |
| 10,316,535 | B2 | 6/2019 | Basha |
| 10,745,259 | B2 | 8/2020 | Kritzer et al. |
| 11,192,763 | B2 | 12/2021 | Kritzer et al. |
| 2010/0089845 | A1 | 4/2010 | Fässler et al. |
| 2020/0232238 | A1 | 7/2020 | Kritzer |
| 2020/0339398 | A1 | 10/2020 | Fässler et al. |
| 2023/0304313 | A1 | 9/2023 | Tarrant |

FOREIGN PATENT DOCUMENTS

| | | | |
|---|---|---|---|
| CN | 210002976 | U | 1/2020 |
| FR | 2882770 | A1 | 9/2006 |
| GB | 1529602 | A | 10/1978 |

* cited by examiner

APPARATUS AND SYSTEM FOR MULTI-LEVEL PARKING

CROSS REFERENCES TO RELATED APPLICATIONS

This application is related to and claims priority from the following U.S. patents and patent applications. This application is a continuation of U.S. patent application Ser. No. 17/702,428, filed Mar. 23, 2022, which is incorporated herein by reference in its entirety.

BACKGROUND OF THE INVENTION

1. Field of the Invention

The present invention relates to devices and systems for multi-level parking, and more specifically to hydraulic devices for two-level parking.

2. Description of the Prior Art

It is generally known in the prior art to provide vertical lift platforms providing for multi-level parking. Existing systems typically include platforms designed to lift a vehicle vertically, allowing at least one additional vehicle to park below the lifted platforms.

Prior art patent documents include the following:

U.S. Pat. No. 6,607,343 for Two-level parking system by inventor Amgar, filed Jul. 21, 1999 and issued Aug. 19, 2003, discloses a parking system including a plurality of lever arms serially and pivotally connected to each other from a nearest lever arm to a furthest lever arm, each lever arm being movable from a first orientation to a second orientation, wherein an angle of each lever arm relative to a ground surface is greater in the second orientation than in the first orientation, the nearest lever arm being connectable to a support structure for supporting thereupon a vehicle to be parked, and drive apparatus operatively connected to the lever arms and operative to sequentially lift each of the lever arms, starting with the furthest lever arm and ending with the nearest lever arm, from its first orientation to its second orientation.

U.S. Pat. No. 5,330,310 for Double-deck parking device by inventor Lin, filed May 10, 1993 and issued Jul. 19, 1994, discloses a double-deck parking device for parking two cars one above the other in order to more efficiently utilize available parking space. The parking device includes a platform which may be moved to a position adjacent a base plate for locating a vehicle thereon. The platform may be raised above the base plate and another vehicle may be parked on the base plate. The platform may be further raised to a vertical position to allow vehicles of differing heights to be mounted on the base plate thus accommodating differing vehicle heights.

U.S. Pat. No. 6,241,049 for Apparatus for storing vehicles with multiple support platforms, collapsible supports between platforms, and a torque-reaction arm lift system by inventor Gooch, filed May 25, 1999 and issued Jun. 5, 2001, discloses an apparatus for storing vehicles. A vertical support structure is mechanically coupled to a horizontal support structure. Multiple support platforms are provided, including at least an upper vehicle support platform and a lower vehicle support platform. At least one lift arm is pivotally coupled between the vertical support structure and the upper vehicle support platform. A collapsible linkage connection is provided between the upper vehicle support platform and the lower vehicle support platform. A lower vehicle support platform is suspendable below the upper vehicle support platform by the collapsible linkage connection. A control system is utilized to operate the at least one lift arm in order to move the apparatus between modes of operation. In a first vehicle loading position, the upper vehicle support platform and the lower vehicle support platform are in a down position with the upper vehicle support platform directly above the lower vehicle support platform. In the second vehicle loading position, the upper vehicle support platform is elevated a predetermined distance above the lower vehicle support platform, but with the lower vehicle support platform in a down position substantially in engagement with a flooring. In a third vehicle loading position, the upper vehicle support platform and the lower vehicle support platform are disposed predetermined distances above the flooring, with the lower vehicle support platform suspended from the upper vehicle support platform by the collapsible linkage connection.

U.S. Pat. No. 5,743,696 for Motor vehicle parking installation by inventor Rossato, filed Mar. 4, 1997 and issued Apr. 28, 1998, discloses a vehicle parking installation having a pair of vertical columns, multiple platforms provided with carriages movable independently of each other along the columns. The carriages are lockable along the columns at predetermined distances which are suitable for accommodating individual vehicles. The platforms may be driven along the columns by a central unit which controls the operation of the installation. A drive member which is applied to each column is controlled by the central unit so that it can releasably connect the drive member to a selected platform to thereby displace the selected platform along the column. Each column has a mechanical locking device spaced at predetermined distances apart, individually controlled by the central unit and movable between an interference position and a non-interference position.

U.S. Pat. No. 10,745,259 for Scissor-lift for vehicles by inventors Kritzer et al., filed Oct. 26, 2017 and issued Aug. 18, 2020, discloses a parking lift for vehicles. The parking lift includes a platform on which a vehicle can be parked and lifted by a pair of scissor-lifts configured to raise and lower the platform to enable parking of a second vehicle beneath the platform. A deck of the platform is provided with a gradual slope throughout its length to enable vehicles with low ground clearance to travel onto the platform without contacting an underside of the vehicle with the deck. The scissor-lifts each include a leg with a recessed portion that increases a spacing between a door of a vehicle parked under the platform and the leg and thus a range of motion available to the door. A pad may be disposed on the leg in the recessed portion to protect the door against damage caused by contacting the leg.

U.S. Pat. No. 11,192,763 for Tilting scissor-lift for vehicles by inventors Kritzer et al., filed Nov. 11, 2019 and issued Dec. 7, 2021, discloses a parking lift for vehicles. The parking lift includes a platform on which a vehicle can be parked and lifted by a pair of scissor-lifts configured to raise and lower the platform to enable parking of a second vehicle beneath the platform. A deck of the platform is provided with a gradual slope throughout its length to enable vehicles with low ground clearance to travel onto the platform without contacting an underside of the vehicle with the deck. Each of the scissor-lifts includes short leg and a long leg that is longer than the short leg. Upon actuation between lowered and raised positions, the legs raise an entry end of the platform a greater vertical distance than an opposite terminal end. The platform is thus tilted upward to place a deck thereof in a substantially level or downwardly sloping orientation from the entry end toward the terminal end.

US Patent Publication No. 2020/0232238 for Three-level vehicle lift by inventor Kritzer, filed Jan. 17, 2020 and published Jul. 23, 2020, discloses a three-level vehicle lift. The lift includes a four-post configuration in which each post includes a pair of vertically extending, side-by-side channels. Two platforms are provided. Each includes a carriage configured to engage a respective one of the channels in each post and a hydraulic actuator and lifting cable system disposed within the platform for lifting the platform. An actuation system having a single hydraulic pump is provided with a valve for selectively supplying hydraulic power to either an upper- or a lower-platform hydraulic circuit. The simplified lift and actuation system configuration reduces manufacturing, shipping, installation, and materials costs and complexities.

US Patent Publication No. 2020/0339398 for Device for parking vehicles by inventors Fassler et al., filed Dec. 27, 2018 and published Oct. 29, 2020, discloses a device for parking a plurality of vehicles or the like above one another, wherein at least one platform is provided, which can be raised and lowered by a lifting device, and a constant velocity traction element is provided on each side of the platform. Each constant velocity traction element is guided at least through a roller on the platform and the rollers of two constant velocity traction elements are connected for rotation by a constant velocity shaft.

U.S. Pat. No. 5,145,304 for Height adjustable vehicle parking apparatus by inventor Rosen, filed Nov. 14, 1990 and issued Sep. 8, 1992, discloses a height adjustable vehicle parking apparatus. The apparatus comprises a base and a pair of upstanding stanchions. A vehicle parking platform is disposed between and moveable along the stanchions. An articulated stabilizer bar assembly comprising a rocker arm and a control arm are pivotally connected to one another and to the parking platform and base respectively. A piston and cylinder assembly extends pivotally from a fixed location on the articulated stabilizing bar assembly. Height adjustable means for supporting the vehicle platform at various heights are provided intermediate the upstanding stanchions. Thus, the subject parking apparatus may be employed in a variety of indoor parking facilities having different height limitations.

U.S. Pat. No. 4,772,172 for Low profile vehicle parking apparatus by inventor Rosen, filed Jul. 14, 1987 and issued Sep. 20, 1988, discloses a low profile vehicle parking apparatus. The apparatus comprises a base and a pair of upstanding stanchions. A vehicle parking platform is disposed between and movable along the stanchions. An articulated stabilizer bar assembly comprising a rocker arm and a control arm are pivotally connected to one another and to the parking platform and base respectively. A piston and cylinder assembly extends pivotally from a fixed location to a pivotal location on the articulated stabilizer bar assembly. Thus, the piston and cylinder assemblies do not add to the height of the apparatus and contribute to the stabilization during the lifting of a vehicle on the parking platform.

U.S. Pat. No. 9,255,419 for Cantilever parking lift by inventors Van Stokes et al., filed Jul. 22, 2013 and issued Feb. 9, 2016, discloses a cantilever parking lift system having columns and a platform including a lift mechanism employing a vertically movable dynamic cross chain sheave assembly positioned adjacent a column, a vertically movable static cross chain sheave assembly positioned adjacent a second column, a cross chain extending from the first base and functionally engaged with the dynamic cross chain sheave assembly and static cross chain sheave assembly and to a block assembly housed in a base, wherein the block assembly is movable along a length of the first base and operable to raise the dynamic cross chain sheave assembly, and wherein the cross chain extends beneath and transversely across the platform. An actuator is positionable in the base, rather than in or around the vertical column.

US Patent Publication No. 2010/0089845 for Storage device for vehicles by inventors Fassler et al., filed May 14, 2008 and published Apr. 15, 2010, discloses a storage device for vehicles, goods or the like with several storage spaces. At least one storage space is located on a lifting or lowering platform. The platform is guided on one or more static pillars, and a motion drive is provided for the platform. The motion drive comprises a moving rod with a traction turning device. Furthermore, the motion drive comprises a traction mechanism, and one end of the traction mechanism engages at the platform.

U.S. Pat. No. 7,770,695 for Vehicle lift device including scissor lift and telescopic upper platform by inventor Myers, filed Aug. 22, 2007 and issued Aug. 10, 2010, discloses a vehicle lift device and method wherein the lift device has upper and lower platforms that may receive vehicles for parking or storage. The lower platform may be selectively raised or lowered between two levels of a parking structure. The upper platform is mounted on telescoping supports. When the car lift device is raised to place the lower platform at the upper level of the parking structure, the telescoping posts retract allowing the upper platform to lower, thereby providing clearance between the upper platform and a ceiling of the parking structure. The posts retract by the weight of the upper platform, and no hydraulic assist is required. When the lift device is lowered to place the lower platform at the lower level of the parking structure, the upper platform engages the floor of the upper level of the parking structure and thereby covers the opening in the floor. The telescoping posts then extend as the lower platform travels to its lowered position at the lower level.

U.S. Pat. No. 5,129,776 for Roadside parking system by inventor Peng, filed Feb. 22, 1991 and issued Jul. 14, 1992, discloses an automatic roadside multi-storied parking system including collapsible parking racks each having a plurality of vertically spaced parking platforms and between each two parking racks a lift conveyer capable of ascending and descending stepwise to reach the level of each parking platform. The parking system is also equipped with an emergency ladder on one side of each rack for a person to climb up or down during an emergency. A wheeled moving device is provided on the bottom of each module of the system to assist in adjustment of the angle and direction of the individual modules and is spring-released to flip into a storage recess for the stability of the modules. Parking racks and lift conveyers are fitted and supported each on both sides thereof with lazy tong-type links and oil cylinders are provided for lifting and unfolding of the parking racks and for raising and lowering of the lift conveyer to or from the level of a selected parking platform.

SUMMARY OF THE INVENTION

The present invention relates to devices and systems for multi-level parking, and more specifically to hydraulic devices for two-level parking.

It is an object of this invention to provide a device capable of providing multi-level parking for a vehicle without requiring that vehicles on lower levels be removed before the upper levels are able to be accessed, and without requiring a parking attendant to help retrieve upper level vehicles.

In one embodiment, the present invention is directed to a multi-level parking apparatus, including at least four support elements, each including a top end and a bottom end, and at least four support arms, each including a first end and a second end, wherein the bottom end of each of the at least four support elements is pivotably attached to at least one base, wherein the top end of each of the at least four support elements is pivotably attached to the first end of one of the at least four support arms, wherein the second end of each of the at least four support arms is attached to a platform configured to hold a parked vehicle, wherein the multi-level parking apparatus is operable to move between a stacked configuration and an unstacked configuration, wherein, in the stacked configuration, the at least four support elements are substantially orthogonal to a ground surface, and the at least four support arms extend downwardly from the top ends of the at least four support elements, and wherein in the unstacked configuration, the at least four support elements are substantially parallel to the ground surface.

In another embodiment, the present invention is directed to a multi-level parking apparatus, including at least four support elements, each including a top end and a bottom end, and at least four support arms, each including a first end and a second end, wherein the bottom end of each of the at least four support elements is pivotably attached to at least one base, wherein the top end of each of the at least four support elements is pivotably attached to the first end of one of the at least four support arms, wherein the second end of each of the at least four support arms is attached to a platform configured to hold a parked vehicle, wherein the multi-level parking apparatus is operable to move between a stacked configuration and an unstacked configuration, and wherein, in moving from the stacked configuration to the unstacked configuration, the at least four support arms pivot about the top ends of the at least four support elements, such that the at least four support arms are substantially parallel to the at least four support elements and extend outwardly from the top ends of the at least four support elements.

In yet another embodiment, the present invention is directed to a multi-level parking apparatus, including at least four support elements, each including a top end and a bottom end, and at least four support arms, each including a first end and a second end, wherein the bottom end of each of the at least four support elements is pivotably attached to at least one base, wherein the top end of each of the at least four support elements is pivotably attached to the first end of one of the at least four support arms, wherein the second end of each of the at least four support arms is attached to a platform configured to hold a parked vehicle, wherein the multi-level parking apparatus is operable to move between a stacked configuration and an unstacked configuration, wherein, in the stacked configuration, the at least four support elements are substantially orthogonal to a ground surface, and the at least four support arms extend downwardly from the top ends of the at least four support elements, wherein in the unstacked configuration, the at least four support elements are substantially parallel to the ground surface, wherein, in moving from the stacked configuration to the unstacked configuration, the at least four support arms pivot about the top ends of the at least four support elements, such that the at least four support arms are substantially parallel to the at least four support elements and extend outwardly from the top ends of the at least four support elements, and wherein the multi-level parking apparatus includes at least one visual indicator and/or at least one audio indicator indicating whether a vehicle is properly parked on the platform or underneath the platform.

These and other aspects of the present invention will become apparent to those skilled in the art after a reading of the following description of the preferred embodiment when considered with the drawings, as they support the claimed invention.

DETAILED DESCRIPTION

Figure 1:
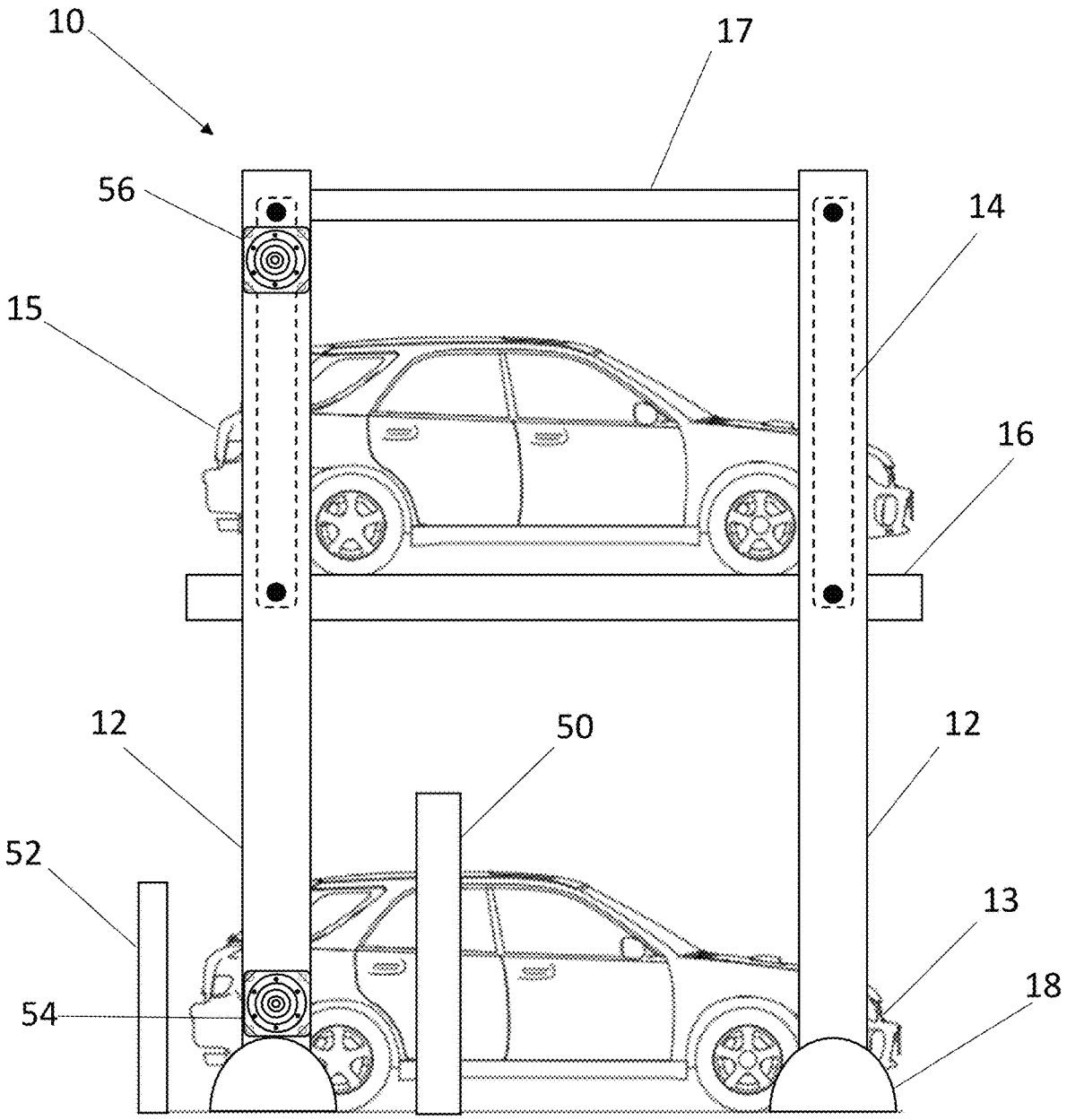
FIG. 1 illustrates a side orthogonal view of a two-level parking platform in a stacked configuration according to one embodiment of the present invention.

The present invention is generally directed to devices and systems for multi-level parking, and more specifically to hydraulic devices for two-level parking.

In one embodiment, the present invention is directed to a multi-level parking apparatus, including at least four support elements, each including a top end and a bottom end, and at least four support arms, each including a first end and a second end, wherein the bottom end of each of the at least four support elements is pivotably attached to at least one base, wherein the top end of each of the at least four support elements is pivotably attached to the first end of one of the at least four support arms, wherein the second end of each of the at least four support arms is attached to a platform configured to hold a parked vehicle, wherein the multi-level parking apparatus is operable to move between a stacked configuration and an unstacked configuration, wherein, in the stacked configuration, the at least four support elements are substantially orthogonal to a ground surface, and the at least four support arms extend downwardly from the top ends of the at least four support elements, and wherein in the unstacked configuration, the at least four support elements are substantially parallel to the ground surface.

In another embodiment, the present invention is directed to a multi-level parking apparatus, including at least four support elements, each including a top end and a bottom end, and at least four support arms, each including a first end and a second end, wherein the bottom end of each of the at least four support elements is pivotably attached to at least one base, wherein the top end of each of the at least four support elements is pivotably attached to the first end of one of the at least four support arms, wherein the second end of each of the at least four support arms is attached to a platform configured to hold a parked vehicle, wherein the multi-level parking apparatus is operable to move between a stacked configuration and an unstacked configuration, and wherein, in moving from the stacked configuration to the unstacked configuration, the at least four support arms pivot about the top ends of the at least four support elements, such that the at least four support arms are substantially parallel to the at least four support elements and extend outwardly from the top ends of the at least four support elements.

In yet another embodiment, the present invention is directed to a multi-level parking apparatus, including at least four support elements, each including a top end and a bottom end, and at least four support arms, each including a first end and a second end, wherein the bottom end of each of the at least four support elements is pivotably attached to at least one base, wherein the top end of each of the at least four support elements is pivotably attached to the first end of one of the at least four support arms, wherein the second end of each of the at least four support arms is attached to a platform configured to hold a parked vehicle, wherein the multi-level parking apparatus is operable to move between a stacked configuration and an unstacked configuration, wherein, in the stacked configuration, the at least four support elements are substantially orthogonal to a ground surface, and the at least four support arms extend downwardly from the top ends of the at least four support elements, wherein in the unstacked configuration, the at least four support elements are substantially parallel to the ground surface, wherein, in moving from the stacked configuration to the unstacked configuration, the at least four support arms pivot about the top ends of the at least four support elements, such that the at least four support arms are substantially parallel to the at least four support elements and extend outwardly from the top ends of the at least four support elements, and wherein the multi-level parking apparatus includes at least one visual indicator and/or at least one audio indicator indicating whether a vehicle is properly parked on the platform or underneath the platform.

As urban areas continue to grow, the growth of parking is fast becoming a major concern to match large population growth. Some cities, like New York City, have strict regulations for developers for minimum numbers of parking spots based on the size and type of development, as described in New York City Zoning Resolution Article III, Chapter 6, § 36-20 (2016), which is incorporated herein by reference in its entirety. However, cities such as New York City treat automated parking facilities, which utilize mechanical lifts to stack cars but do not require an attendant to maneuver parked vehicles, differently from attended parking facilities, as described in New York Zoning Resolution Article I, Chapter 3, § 13-02, 13-27, and 13-101, each of which is incorporated herein by reference in its entirety. According to these zoning regulations, automated parking facilities are allowed to have less square footage of parking space than attended parking facilities for equivalent numbers of vehicles. As such, it is desirable to utilize parking systems that do not require an attendant.

Stacked parking devices have become more popular in recent years. Most commonly, these systems include a platform that is configured to vertically lift after a vehicle parks on it, allowing another vehicle to park underneath the platform, such as the systems described in U.S. Pat. Nos. 11,192,763, 10,745,259, 9,255,419, 7,770,695, 5,743,696, 5,145,304, 5,129,776, 4,772,172, U.S. Patent Publication Nos. 2020/0232238, 2020/0339398, and 2010/0089845, and existing products such as PARKMATIC's Double Stacker or Triple Stacker. However, vertical lift systems have an inherent spatial efficiency problem, namely that, in order for the upper level cars to be brought down, the lower level cars must be removed. This increases the amount of time needed for these systems to be used and requires an attendant who has access to the lower level car keys. Some companies have attempted to solve the problems of vertical lifts with devices such as PARKMATIC's Carousel or Puzzle systems, which attempt to allow each individual car to be accessible without an attendant. However, each of these systems have significant drawbacks. First, both require very large amounts of space, which is typically impractical for indoor sections of parking garages. This space is generally required as neither system is capable of being used with only two vehicles (and typically requires more than two vehicles). For example, the Puzzle system explicitly requires at least one empty space so that the cars are able to be shuffled around, a system that does not work (or requires large amounts of superfluous space) for only two vehicles. Therefore, there is a need for a system having a smaller vertical footprint that is practical for parking smaller numbers of vehicles (e.g., two or three vehicles).

Other existing small-scale stacking configurations also include a number of drawbacks. For example, the system described in U.S. Pat. No. 6,607,343 utilizes chains in order to drive the stacking and unstacking mechanism of the device. The chain system described introduces a number of disadvantages, including a greater number of moving parts, which decreases the long term reliability of the system. Furthermore, several of the embodiments described in U.S. Pat. No. 6,607,343 do not appear to be able to accommodate larger vehicles on the lower level while still allowing for the upper level vehicles to be safely lowered. Therefore, there is a need for a more reliable stacked parking apparatus, capable of being used for a wider range of vehicle types.

Referring now to the drawings in general, the illustrations are for the purpose of describing one or more preferred embodiments of the invention and are not intended to limit the invention thereto.

FIG. 1 illustrates a side orthogonal view of a two-level parking platform in a stacked configuration according to one embodiment of the present invention. The apparatus 10 includes at least four support members 12 (two of which are visible in FIG. 1) each pivotably connected on one side to a base 18. In one embodiment, each of the at least four support members 12 is connected to a separate base 18. In one embodiment, the base 18 is attached to a top surface of a ground-level platform. In another embodiment, each of the at least four support members 12 is connected to the same base. In one embodiment, the apparatus 10 includes a first locking mechanism capable of locking one or more of the at least four support members 12 into an orientation relative to the base 18 (e.g., locked into being orthogonal to a ground surface). In one embodiment, each of the at least four support members 12 are connected to a primary hydraulic motor 54 operable to pivot the support member 12 about the base 18. An opposite end of each of the at least four support members 12 from that connected to the base 18 is pivotably connected to a first end of a support arm 14. In one embodiment, the apparatus 10 includes a second locking mechanism capable of locking an orientation of each of the support arms 14 relative to the corresponding support member 12. A second end of each support arm 14 is pivotably connected to a platform 16. In one embodiment, the second end of each support arm 14 is pivotably connected to a side wall of the platform 16. In one embodiment, each support arm 14 is connected to at least one secondary hydraulic motor 56, which is operable to rotate the support arm 14 about the corresponding support member 12. In one embodiment, the apparatus 10 includes a third locking mechanism capable of locking an orientation of each of the support arms 14 relative to the platform 16. In one embodiment, at least one crossbar 17 connects two of the support arms 14 adjacent to the same side of the vehicle, providing structural support for the apparatus 10. In one embodiment, at least one limit switch 72 is attached to the platform 16 at a position proximate to the pivot connection between the support arm 14 and the platform 16.

In one embodiment, the base 18 is attached to the ground surface (e.g., with an anchor extending through the base into the ground surface). Firm attachment between the base 18 and the ground is important as the apparatus 10 is designed to lift a vehicle to the side of the apparatus 10 and set it down, which results in larger amounts of force applied to the base 18. Attaching the base 18 to the ground therefore helps to prevent the apparatus 10 from tipping over. In one embodiment, a concrete foundation pad is poured over the base 18 in order to firmly attach the base 18 to the ground. In another embodiment, the base 18 includes one or more anchors (e.g., steel concrete screws) inserted into holes drilled in the ground in order to firmly attach the base 18 to the ground. In one embodiment, the apparatus 10 is connected to a control panel 100. In one embodiment, the control panel 100 houses a processor operable to control the movement of the apparatus 10 between stacked and unstacked configurations. In one embodiment, the control panel 100 is operable to control the hydraulic motors within the apparatus 10. Although the control panel 100 and limit switch 72 are not shown in every figure accompanying the present application to enable visualization of other components of the present invention in these figures, one of ordinary skill in the art will understand that the control panel 100 and limit switch 72 are operable to be included in the other figures as needed or desired.

The apparatus is capable of moving between a stacked configuration and an unstacked configuration. In a stacked configuration, as shown in FIG. 1, the at least four support members 12 are substantially orthogonal relative to a ground surface (i.e., typically vertical). In this configuration, the at least four support members 12 extend upwardly from the base 18 and the support arms 14 extend downwardly from the top of the at least four support members 12. Therefore, in the stacked configuration the support arms 14 are substantially parallel to the at least four support members 12, and substantially orthogonal to the ground surface. When in a stacked configuration or when moving between the stacked configuration and the unstacked configuration, the platform 16 is preferably parallel to the ground surface, and more preferably orthogonal to the direction of gravity, such that vehicles positioned on the platform 16 do not fall off during operation of the apparatus 10.

The apparatus 10 as described herein is designed to lift and hold vehicles, including but not limited to, cars, tractor trailers, trailers, trucks, motorcycles, bicycles, boats, scooters, and/or other types of vehicles. Advantageously, the dimensions of the apparatus 10 are operable to be customized for the type of vehicle that is being lifted and held by the apparatus 10. The apparatus 10 lifts the platform 16 including a first vehicle 15 once the first vehicle 15 is secure on the platform 16, such that a second vehicle 13 is able to be parked underneath the platform 16, providing more space for parking. The apparatus 10 is designed such that it is able to be used in indoor parking garages or in outdoor spaces. However, one of ordinary skill in the art will understand that the present invention is capable of being used with larger vehicles and is able to be used for non-parking purposes such as for storage of materials.

In one embodiment, the two-level parking apparatus includes at least one visual indicator (e.g., at least one light, at least one display screen, etc.) and/or at least one auditory indicator (e.g., at least one speaker). In one embodiment, the at least one visual indicator and/or the at least one auditory indicator is connected to at least one sensor. In one embodiment, the at least one sensor includes at least one weight sensor. When the at least one weight sensor detects that the full weight of a vehicle is on the platform, the at least one visual indicator activates (e.g., turns at least one light on, turns at least one light a different color, displays a success screen on the at least one display screen, etc.) and/or the at least one audio indicator activates (e.g., plays at least one sound, stops playing at least one sound, etc.). In another embodiment, when the at least one weight sensor detects that weight is applied to the platform but that the full weight of the vehicle is not on the platform, the at least one visual indicator activates (e.g., turns at least one light on, turns at least one light a different color, displays a success screen on the at least one display screen, etc.) and/or the at least one audio indicator activates (e.g., plays at least one sound, stops playing at least one sound, etc.). In one embodiment, the at least one sensor includes at least one camera connected to a processor, wherein the processor is operable to use known techniques of computer vision and object recognition to detect whether a vehicle is properly parked on top of a platform or not. In one embodiment, when the at least one camera detects that the vehicle is properly parked on the platform, the at least one visual indicator activates (e.g., turns at least one light on, turns at least one light a different color, displays a success screen on the at least one display screen, etc.) and/or the at least one audio indicator activates (e.g., plays at least one sound, stops playing at least one sound, etc.). In one embodiment, when the at least one camera detects that the vehicle is not properly parked on the platform, the at least one visual indicator activates (e.g., turns at least one light on, turns at least one light a different color, displays a success screen on the at least one display screen, etc.) and/or the at least one audio indicator activates (e.g., plays at least one sound, stops playing at least one sound, etc.). In one embodiment, as shown in FIG. 1, the at least one camera includes a primary camera 50 and a secondary camera 52. In one embodiment, the primary camera 50 is elevated higher than the secondary camera 52 and checks that the second vehicle 13 does not extend above a preset height threshold. In one embodiment, the secondary camera 52 is positioned to the rear of the parking space and checks to make sure the second vehicle 13 is adequately pulled forward such that the platform 16 does not impact the second vehicle 13 when the platform 16 is moved. In one embodiment, one or more bumpers (e.g., rubber stoppers at each corner of the platform) are attached to a bottom surface of the platform 16, such that the platform is less likely to be damaged by repeated contact with the ground.

Figure 2:
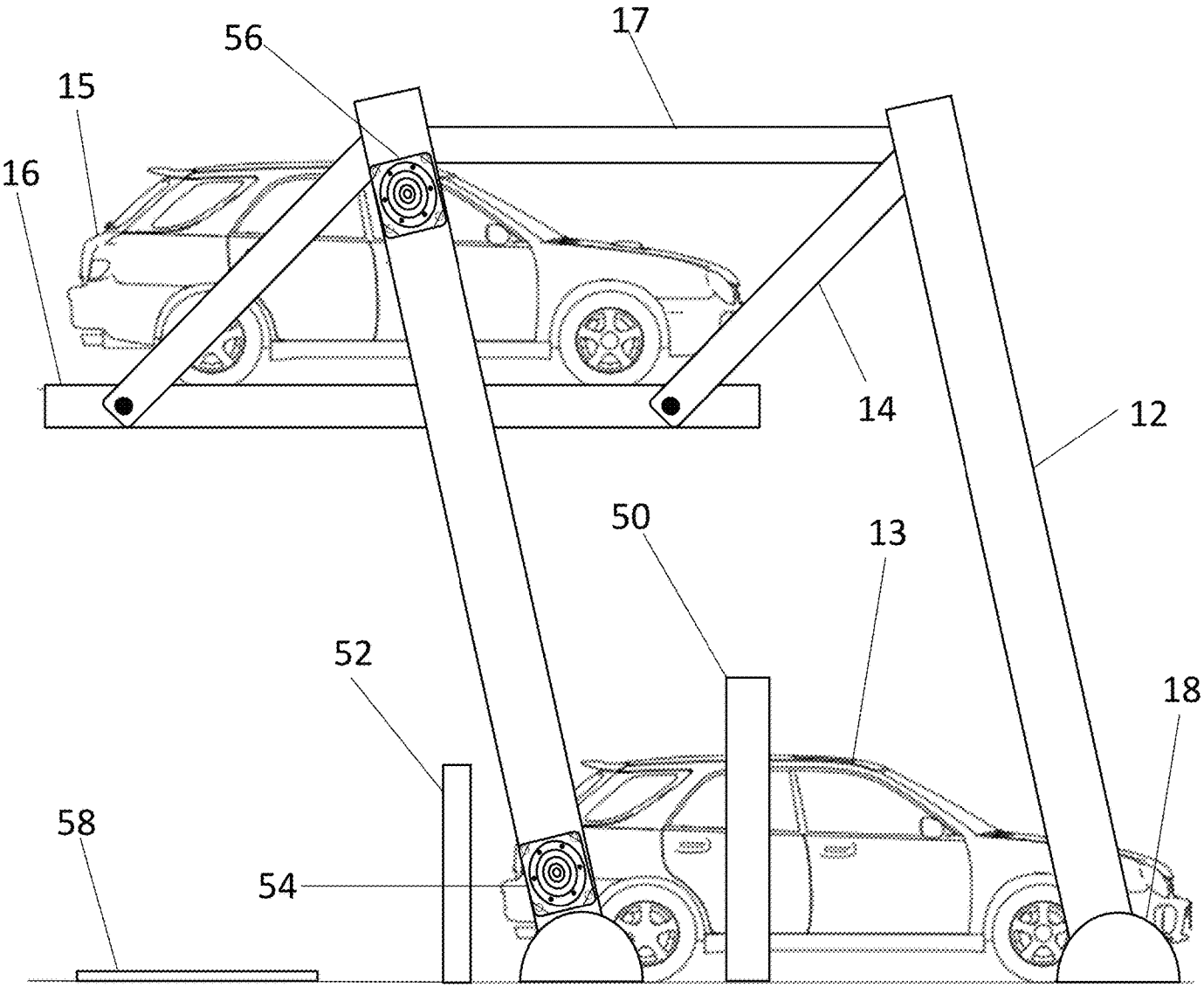
FIG. 2 illustrates a side orthogonal view of a two-level parking platform in an intermediate position between a stacked configuration and an unstacked configuration according to one embodiment of the present invention.

FIG. 2 illustrates a side orthogonal view of a two-level parking platform in an intermediate position between a stacked configuration and an unstacked configuration according to one embodiment of the present invention. In one embodiment, in moving from a stacked configuration to an unstacked configuration, the at least four support elements 12 pivot about the base 18 to the same side and at approximately the same angle. In one embodiment, the support arms 14 pivot relative to the at least four support elements 12 in the same direction that the at least four support elements 12 pivot relative to the base 18. For example, in FIG. 2, the at least four support elements 12 pivot to the left, while the support arms 14 pivot to the left of the at least four support elements 12. However, in another embodiment, the support arms 14 pivot in a direction opposite to the direction that the at least four support elements 12 pivot.

Figure 3:
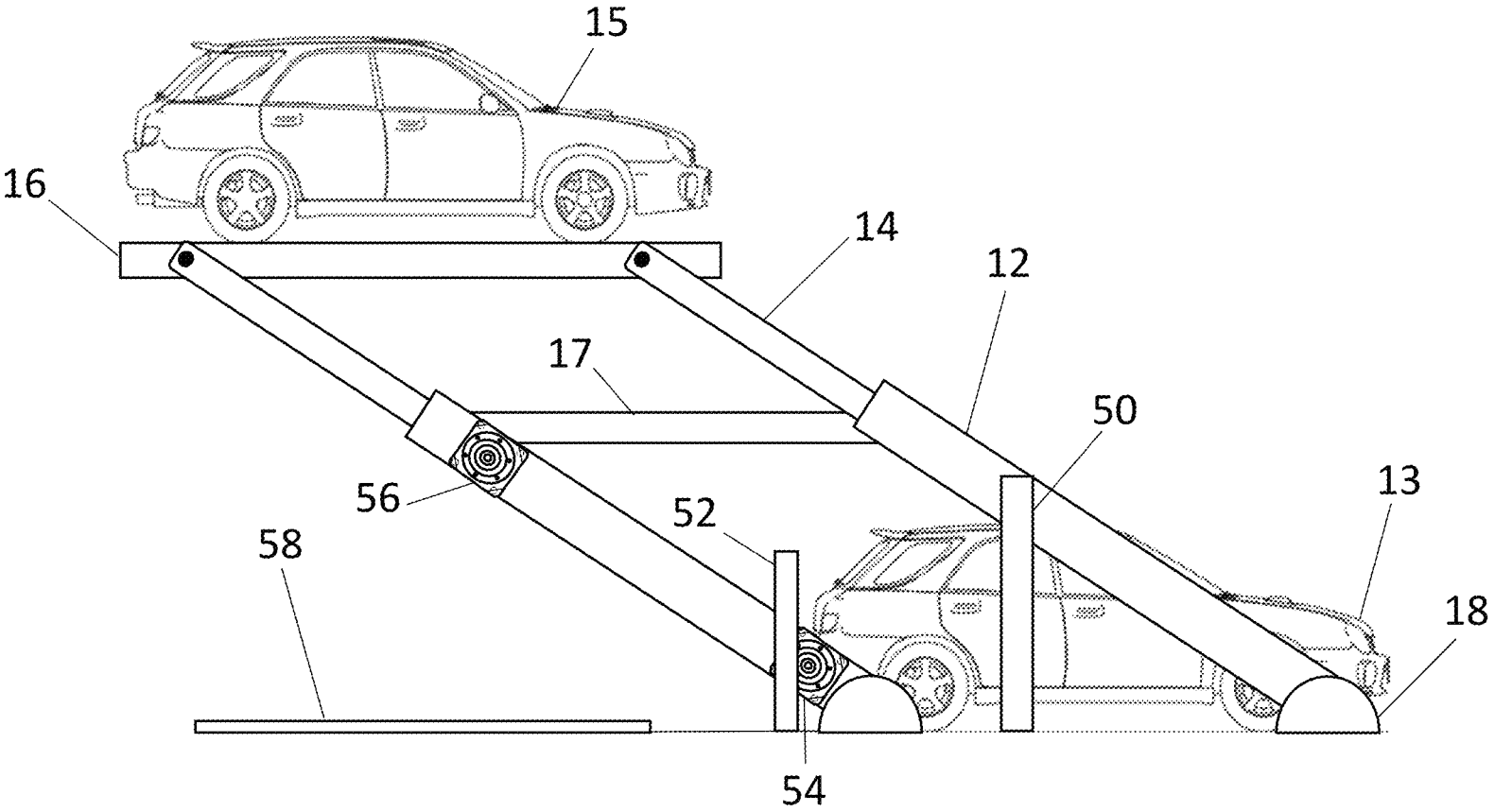
FIG. 3 illustrates a side orthogonal view of a two-level parking platform in an intermediate position between a stacked configuration and an unstacked configuration according to one embodiment of the present invention.

In moving from a stacked configuration to an unstacked configuration, the support arms 14 continue to pivot relative to the at least four support elements 12 until the support arms 14 are again substantially parallel to the at least four support elements 12, but extend outwardly away from the at least four support elements 12, as shown in FIG. 3. It is useful for the apparatus 10 to fully rotate the support arms 14 before the apparatus 10 collapses, as it causes the platform 16 to be moved horizontally before the platform 16 is ever vertically dropped, decreasing the likelihood that it contacts any vehicle parked beneath the platform 16. This is in contrast to the system described in U.S. Pat. No. 6,607,343, where the platform has not fully outstretched horizontally before the platform begins to descend. In one embodiment, the platform is fully outstretched horizontally when the platform 16 is approximately 5 to 6 feet above the ground. Therefore, in one embodiment, the platform 16 does not sink below its original elevation before the support arms 14 are fully rotated.

In moving from an unstacked configuration to a stacked configuration, the mechanism as described above works in reverse. The support arms 14 and the at least four support elements 12 are parallel to one another in the unstacked configuration. The support arms 14 and the at least four support elements 12 remain parallel while the at least four support elements 12 pivot to the right, such that the platform is lifted into the air a sufficient distance so as to clear any vehicle parked on the first level. After reaching the maximum height, the support arms 14 begin to rotate counterclockwise (in the orientation shown in FIG. 2, viewed from the other side of the platform, the support arms rotate clockwise) relative to the at least four support elements 12 until the support arms 14 and the at least four support elements 12 are again parallel and are substantially orthogonal to the ground. In one embodiment, the apparatus 10 determines when the platform 16 is at a maximum height and/or when the at least four support elements 12 are substantially orthogonal to the ground through triggering of a limit switch, as further discussed with reference to FIGS. 6-9 below.

In one embodiment, the apparatus is able to move from a stacked configuration to an unstacked configuration by either moving to the left or to the right. Therefore, it is possible for the apparatus to have two unstacked configurations, one in which the first vehicle 15 is behind the second vehicle 13, as shown in the mechanism in FIGS. 2 and 3, and one in which the first vehicle 15 is in front of the second vehicle 13. Moving into an unstacked configuration wherein the first vehicle 15 is in front of the second vehicle 13 is equivalent to the process of moving between a stacked configuration and an unstacked configuration as discussed with reference to FIG. 2 above, with the exception that the at least four support elements 12 and the support arms 14 move to the right, rather than to the left. Allowing the apparatus 10 to move in either direction allows the first vehicle 15 to essentially "skip over" the second vehicle 13 without moving the second vehicle 13.

As shown in FIGS. 2 and 3, in one embodiment the apparatus 10 is in communication with at least one collision sensor 58. In one embodiment, the at least one collision sensor 58 includes at least one magnetic loop operable to detect if an obstruction (e.g., another vehicle) is parked in a location would be contacted by the platform 16 moving into the unstacked configuration. In one embodiment, if the at least one collision sensor 58 detects an obstruction, then a signal is transmitted to the apparatus 10 and the apparatus 10 is prevented from moving into an unstacked configuration until the obstruction is removed.

Figure 4:
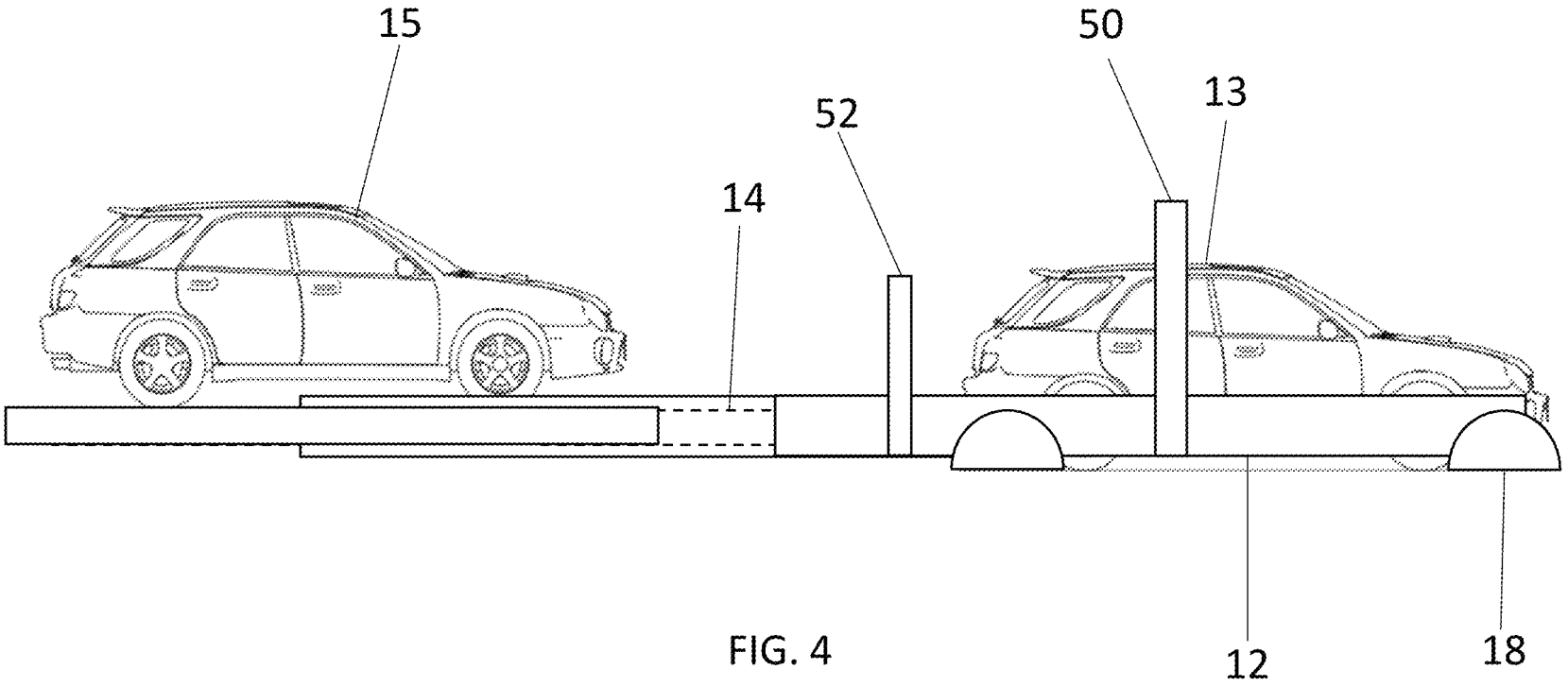
FIG. 4 illustrates a side orthogonal view of a two level parking platform in an unstacked configuration according to one embodiment of the present invention.

FIG. 4 illustrates a side orthogonal view of a two-level parking platform in an unstacked configuration according to one embodiment of the present invention. After the support arms 14 fully rotate, the at least four support elements 12 continue to pivot until the least four support elements 12 are substantially parallel with the ground surface (e.g., substantially horizontal). In one embodiment, when the apparatus 10 is in a fully unstacked configuration, the platform 16 is in contact with the ground surface. Because the support arms 14 are attached to a side wall of the platform 16, no part of the mechanism of the apparatus 10 needs to be below the platform 16 when it is fully unstacked. Therefore, the platform 16 is able to be fully flush with the ground surface and vehicles are able to more easily drive off.

Figure 5:
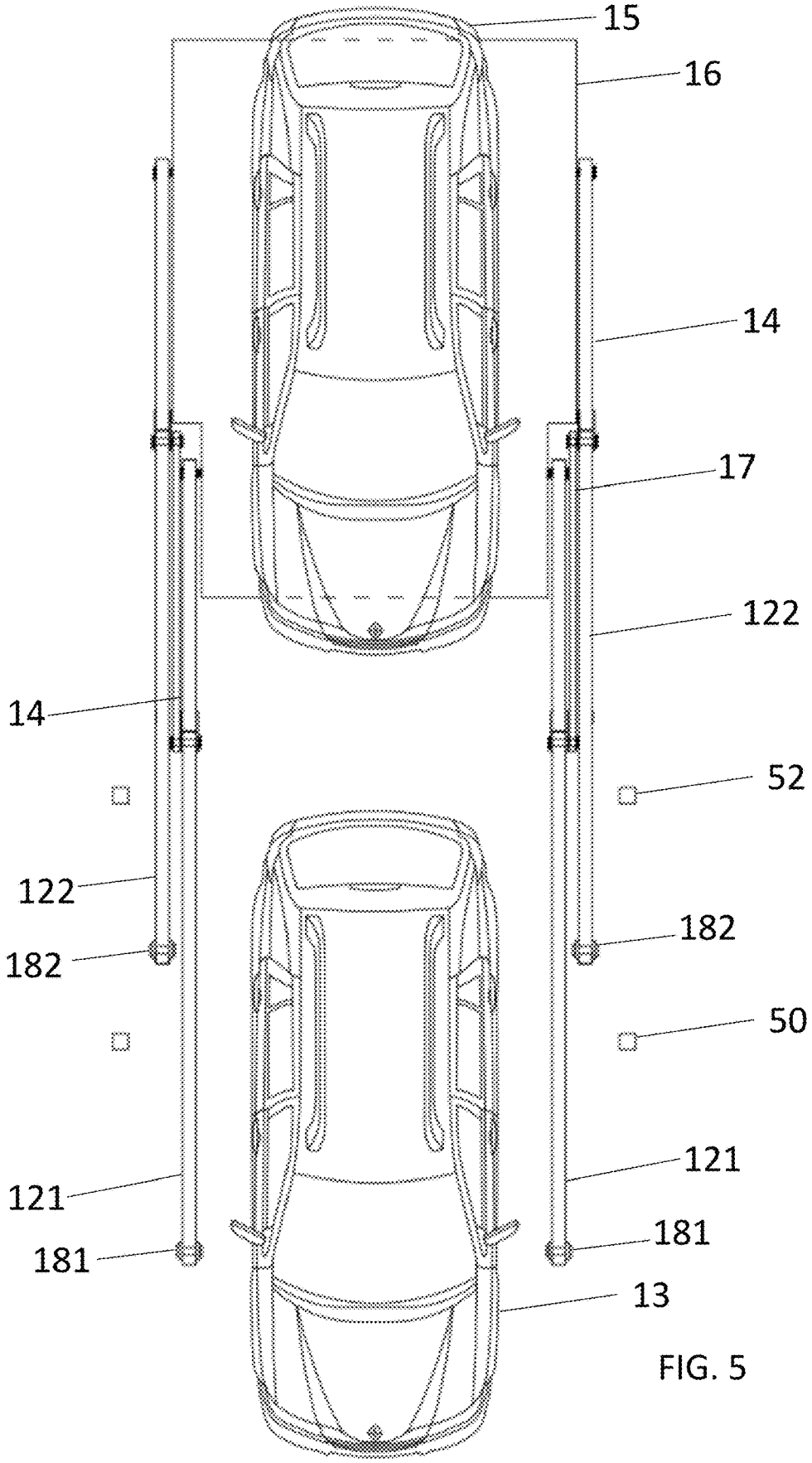
FIG. 5 illustrates a top orthogonal view of a two level parking platform in an unstacked configuration according to one embodiment of the present invention.

FIG. 5 illustrates a top orthogonal view of a two-level parking platform in an unstacked configuration according to one embodiment of the present invention. In one embodiment, a first pair of support elements 121 is connected to a first pair of bases 181 and a first pair of support elements 122 is connected to a second pair of bases 182. There is a shorter distance between the first pair of bases 181 than between the second pair of bases 182. This allows the apparatus to fully fold horizontally in the unstacked configuration. As shown in FIG. 5, when in an unstacked configuration, the second pair of support elements 122 and therefore the support arms 14 connected to the second pair of support elements is positioned outwardly relative to the first pair of support elements 121 and the support arms 14 connected to the first pair of support elements 121, with the crossbar 17 between the first pair of support elements 121 and the second pair of support elements 122.

Figure 6:
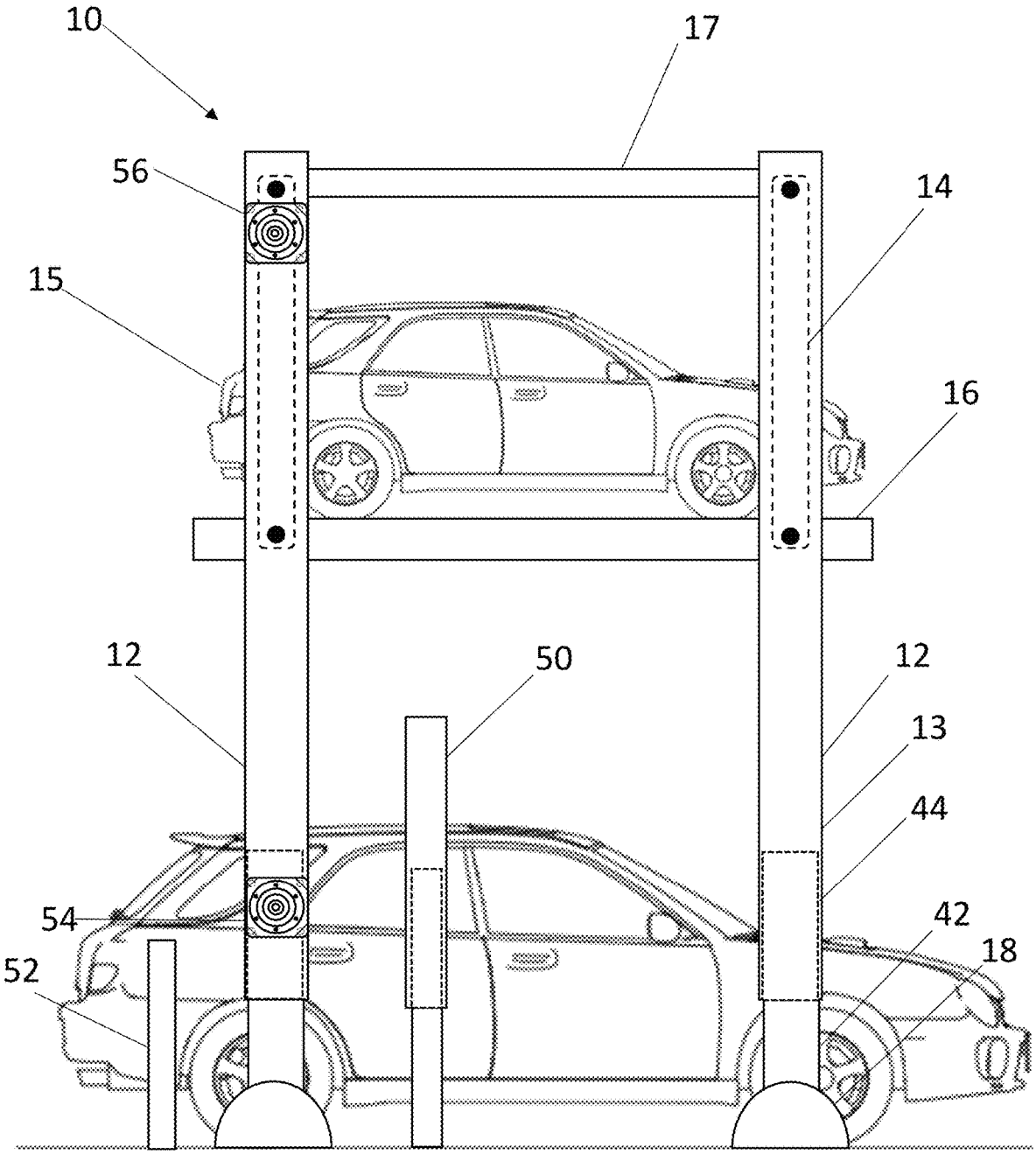
FIG. 6 illustrates a side orthogonal view of a two level parking platform having an adjustable height according to one embodiment of the present invention.

FIG. 6 illustrates a side orthogonal view of a two level parking platform having an adjustable height according to one embodiment of the present invention. In one embodiment, the at least four support elements 12 have an adjustable height. In a downward position, the at least four support elements 12 each include a retractable member 42 position within a recess 44 defined in the bottom end of each of the at least four support elements 12. When the platform is moved into an upward position, the retractable members 42 move out of the recess 44, such that the retractable member 42 is visible outside of the correspond support element 12.

In one embodiment, the platform is not only able to move between one downward position and one upward position, but is able to move to a range of positions between a fully downward position (wherein the retractable members 42 are fully within the recesses 44) and a fully upward position (wherein the retractable members 42 are fully outside of the recesses 44). In one embodiment, the height of the primary camera 50 is also adjustable. In one embodiment, the height of the primary camera 50 automatically adjusts to match the height of the at least four support elements 12. Adjusting the height of the platform is useful for accommodating vehicles of different sizes.

Figure 7:
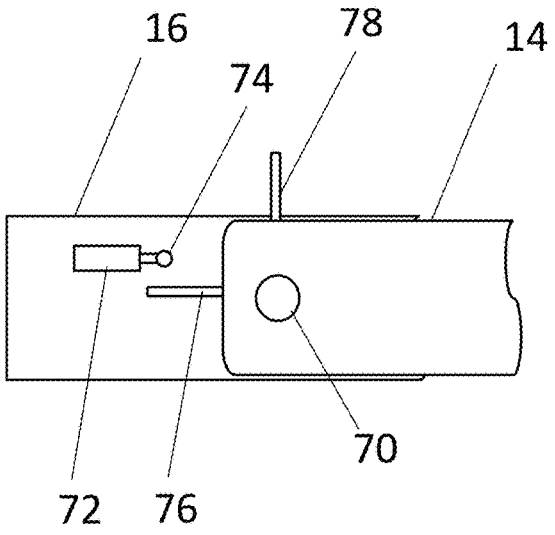
FIG. 7 illustrates an enlarged view of a limit switch mechanism when a parking platform is in an unstacked configuration according to one embodiment of the present invention.

FIG. 7 illustrates an enlarged view of a limit switch mechanism when a parking platform is in an unstacked configuration according to one embodiment of the present invention. In one embodiment, at least one limit switch 72 is attached to the platform 16 at a position proximate to the pivot connection 70 between a support arm 14 and the platform 16. In one embodiment, the limit switch 72 includes a movable member 74 operable to be moved upwardly or downwardly when pressure is applied to the movable member 74. The second end of the support arm 14 (i.e., the end of the support arm 14 attached to the platform 16) includes a first prong 76 and a second prong 78. In an unstacked configuration, as shown in FIG. 7 the first prong 76 is oriented approximately parallel to the top surface of the platform 16 and the second prong 78 is oriented approximately orthogonal to the top surface of the platform 16 and extends upwardly from the support arm 14.

Figure 8:
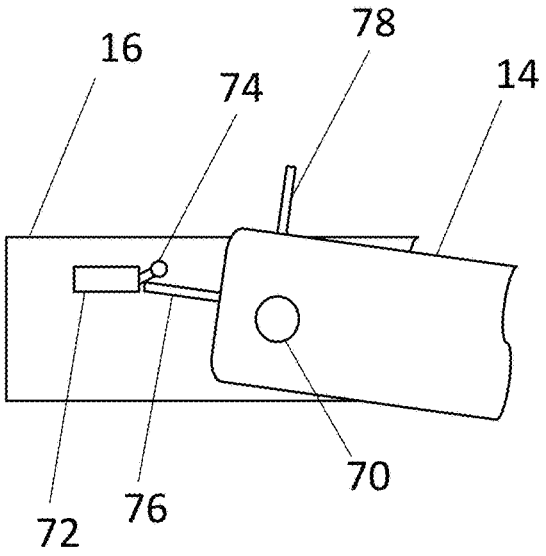
FIG. 8 illustrates an enlarged view of a limit switch mechanism for a parking platform when support arms are fully rotated during a transition between a stacked configuration and an unstacked configuration according to one embodiment of the present invention.

As shown in FIG. 8, when the apparatus moves from an unstacked configuration to a stacked configuration, the first prong 76 pushes upwardly on the movable member 74 of the limit switch 72. In one embodiment, the upward movement of the movable member 74 transmits a signal to a processor within the apparatus that the platform 16 is now in a maximally upward position, causing the support arm 14 to begin rotating with respect to the corresponding support member. In another embodiment, movement of the movable member 74 does not affect the rotation of the support arm 14.

Figure 9:
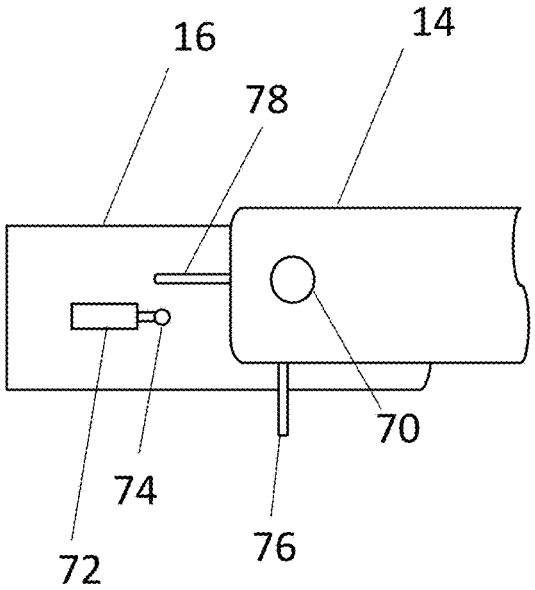
FIG. 9 illustrates an enlarged view of a limit switch mechanism when a parking platform is in a stacked configuration with a vehicle loaded according to one embodiment of the present invention.
Figure 10:
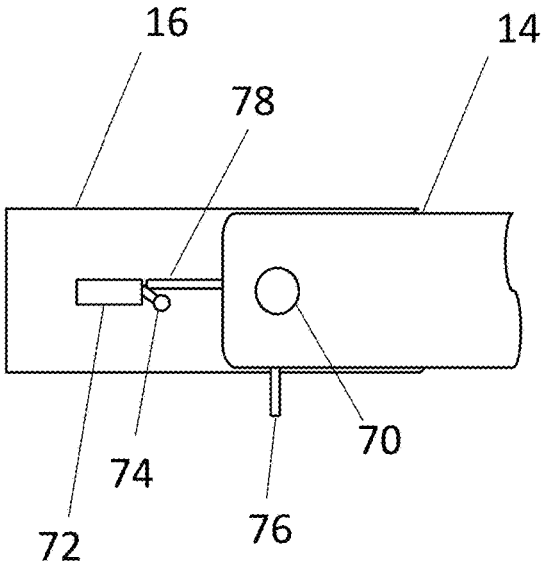
FIG. 10 illustrates an enlarged view of a limit switch mechanism when a parking platform is in an unstacked configuration with no vehicle loaded according to one embodiment of the present invention.

When the apparatus is in a stacked configuration, as shown in FIGS. 9 and 10, the first prong 76 is oriented approximately orthogonal to the top surface of the platform 16 and extends downwardly from the support arm 14, while the second prong 78 is oriented approximately parallel to the top surface of the platform 16. In one embodiment, as shown in FIG. 9, when the apparatus is in a stacked configuration and a vehicle is loaded on the platform 9, the weight of the vehicle on the platform causes the movable member 74 to not contact the second prong 78. In one embodiment, lack of contact between the movable member 74 and the second prong 78 in the stacked configuration sends a signal to a processor of the apparatus that new users are not able to register to park a vehicle on the second level of the apparatus. As shown in FIG. 10, when a vehicle is not parked on the platform 16 and therefore the weight of a vehicle is not applied to the top surface of the platform 16, then the second prong 78 is configured to contact the movable member 74 of the limit switch 72. In one embodiment, contact between the second prong 78 and the movable member 74 sends a signal to a processor of the apparatus that new users are able to register to park a vehicle on the second level of the apparatus. In another embodiment, the presence or absence of a vehicle on the platform 16 does not move the platform 16 relative to the support arm 14. Instead, in a stacked configuration, the second prong 78 is always in contact with the movable member 74, which indicates to the processor of the apparatus that the apparatus is in a fully stacked configuration. In one embodiment, the apparatus is operable to transmit information regarding whether a vehicle is parked on the platform 16 or below the platform 16 to a central server, including a processor and a memory. In one embodiment, the central server generates a map of a parking environment (e.g., a parking garage) indicating which spots are occupied and which spots are not occupied. In one embodiment, the map is able to be accessed through an application on a user device such that users are more easily able to view the parking availability in the parking environment.

In one embodiment, the apparatus includes a processor and a memory and is in network communication with at least one remote device (e.g., a cellular phone, a tablet, a computer, etc.). The apparatus is operable to receive commands from the at least one remote device to move between the stacked configuration and the unstacked configuration. In one embodiment, the apparatus is operable to transmit at least one unique passcode to the at least one remote device when a vehicle is registered for use with the system. The apparatus is configured to only move between the stacked configuration and the unstacked configuration when the at least one unique passcode is received by the at least one remote device. In one embodiment, the apparatus includes at least one keypad. In one embodiment, when a vehicle is parked on the platform of the apparatus, the at least one keypad is operable to accept payment (e.g., with a credit card) and/or automatically provides a unique passcode for accessing the vehicle. In one embodiment, when a vehicle is parked on the platform of the apparatus, the at least one keypad is operable to receive at least one passcode set by the user, which is required in order to retrieve the vehicle.

In one embodiment, the apparatus is entirely operated only using hydraulic devices. In one embodiment, the apparatus does not use chains to drive the movement of the at least four support elements and/or the support arms. In one embodiment, the control panel includes a hydraulic tank containing hydraulic fluid. The hydraulic tank is connected to the hydraulic motors of the system discussed above via tubing. When power is provided to the hydraulic tank, the hydraulic fluid is able to pass through the hoses to the hydraulic motors to activate the hydraulic motors, thus allowing for the pivoting of the support arms and/or the at least four support elements.

Figure 11:
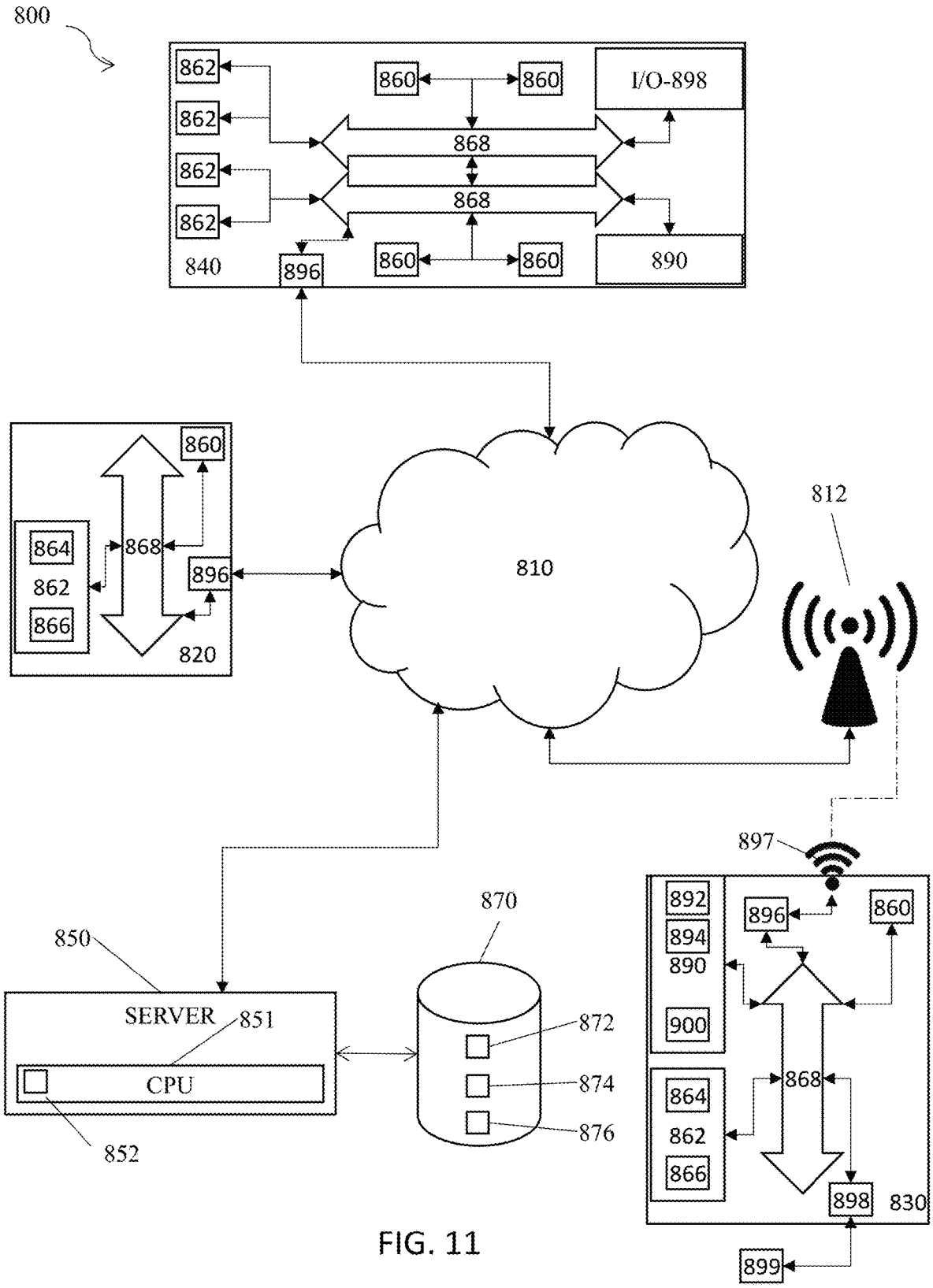
FIG. 11 is a schematic diagram of a system of the present invention.

FIG. 11 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFD), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 11, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 11, is operable to include other components that are not explicitly shown in FIG. 11, or is operable to utilize an architecture completely different than that shown in FIG. 11. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A multi-level parking apparatus, comprising:

at least four support elements, each including a top end and a bottom end;

at least four support arms, each including a first end and a second end;

at least one base; and a platform;

wherein the bottom end of each of the at least four support elements is attached to the at least one base;

wherein the top end of each of the at least four support elements is attached to the first end of one of the at least four support arms;

wherein the second end of each of the at least four support arms is attached to the platform;

wherein the multi-level parking apparatus is operable to move between a stacked configuration and an unstacked configuration;

wherein, in the stacked configuration, the at least four support elements are substantially orthogonal to a ground surface, and the at least four support arms extend downwardly from the top ends of the at least four support elements; and wherein, in moving from the stacked configuration to the unstacked configuration, the at least four support arms rotate about the top ends of the at least four support elements, such that the at least four support arms are substantially parallel to the at least four support elements and extend outwardly from the top ends of the at least four support elements.

2. The multi-level parking apparatus of claim 1, wherein the at least four support arms rotate such that the at least four support arms are substantially parallel to the at least four support elements and extend outwardly from the top ends of the at least four support elements before the at least four support elements rotate such that the at least four support elements are substantially parallel to the ground surface.

3. The multi-level parking apparatus of claim 1, wherein the multi-level parking apparatus is in network communication with at least one remote device, and wherein the multi-level parking-apparatus is operable to receive a command from the at least one remote device.

4. The multi-level parking apparatus of claim 1, wherein the platform remains substantially parallel with the ground surface when the multi-level parking apparatus moves between the stacked configuration and the unstacked configuration.

5. The multi-level parking apparatus of claim 1, wherein the at least one base includes separate bases, and wherein each of the at least four support elements is attached to a separate base.

6. The multi-level parking apparatus of claim 1, further including at least one hydraulic motor, operable to rotate the at least four support arms around the top end of a corresponding one of the at least four support elements.

7. The multi-level parking apparatus of claim 1, further including at least one hydraulic motor, operable to rotate the at least four support elements about the at least one base.

8. A multi-level parking apparatus, comprising:

a plurality of support elements, each including a top end and a bottom end;

a plurality of support arms, each including a first end and a second end;

at least one base; and a platform;

wherein the bottom end of each of the plurality of support elements is attached to the at least one base;

wherein the top end of each of the plurality of support elements is attached to the first end of one of the plurality of support arms;

wherein the second end of each of the plurality of support arms is attached to the platform;

wherein the multi-level parking apparatus is operable to move between a stacked configuration and an unstacked configuration; and wherein, in moving from the stacked configuration to the unstacked configuration, the plurality of support arms rotate about the top ends of the plurality of support elements, such that the plurality of support arms are substantially parallel to the plurality of support elements and extend outwardly from the top ends of the plurality of support elements.

9. The multi-level parking apparatus of claim 8, wherein in the unstacked configuration, plurality of support elements are substantially parallel to a ground surface.

10. The multi-level parking apparatus of claim 9, wherein the plurality of support arms rotate such that the plurality of support arms are substantially parallel to the plurality of support elements and extend outwardly from the top ends of the plurality of support elements before the plurality of support elements pivot such that the plurality of support elements are substantially parallel to the ground surface.

11. The multi-level parking apparatus of claim 8, wherein the multi-level parking apparatus is in network communication with at least one remote device, and wherein the multi-level parking apparatus is operable to receive a command from the at least one remote device.

12. The multi-level parking apparatus of claim 8, wherein the platform remains substantially parallel with a ground surface when the multi-level parking apparatus moves between the stacked configuration and the unstacked configuration.

13. The multi-level parking apparatus of claim 8, wherein the at least one base is fixedly attached to a ground surface.

14. A multi-level parking apparatus, comprising:

at least four support elements, each including a top end and a bottom end;

at least four support arms, each including a first end and a second end;

at least one base; and a platform;

wherein the bottom end of each of the at least four support elements is attached to the at least one base;

wherein the top end of each of the at least four support elements is attached to the first end of one of the at least four support arms;

wherein the second end of each of the at least four support arms is attached to the platform;

wherein the multi-level parking apparatus is operable to move between a stacked configuration and an unstacked configuration;

wherein, in the stacked configuration, the at least four support elements are substantially orthogonal to a ground surface, and the at least four support arms extend downwardly from the top ends of the at least four support elements;

wherein, in moving from the stacked configuration to the unstacked configuration, the at least four support arms rotate about the top ends of the at least four support elements, and extend outwardly from the top ends of the at least four support elements;

wherein the multi-level apparatus includes at least one keypad operable to receive at least one passcode to retrieve the vehicle; and wherein the at least four support arms rotate such that the at least four support arms are substantially parallel to the at least four support elements and extend outwardly from the top ends of the at least four support elements before the at least four support elements pivot such that the at least four support elements are substantially parallel to the ground surface.

15. The multi-level parking apparatus of claim 14, wherein the multi-level parking apparatus is in network communication with at least one remote device, and wherein the multi-level parking apparatus is operable to receive a command from the at least one remote device.

16. The multi-level parking apparatus of claim 14, wherein the at least one keypad is operable to accept payment and provide a unique passcode for accessing the vehicle.

17. The multi-level parking apparatus of claim 14, wherein the platform remains substantially parallel with the ground surface when the multi-level parking apparatus moves between the stacked configuration and the unstacked configuration.

18. The multi-level parking apparatus of claim 14, wherein the at least one base is fixedly attached to the ground surface.

* * * * *